US005439125A

United States Patent [19]

Bloch

[11] Patent Number: 5,439,125

[45] **Date of Patent: * Aug. 8, 1995**

[54] DRINKING DEVICES

[76] Inventor: Harry S. Bloch, 871 Green Ridge Cir., Langhorne, Pa. 19053

[ * ] Notice: The portion of the term of this patent subsequent to May 18, 2010 has been disclaimed.

[21] Appl. No.: 49,467

[22] Filed: Apr. 20, 1993

Related U.S. Application Data

[63] Continuation-in-part of Ser. No. 965,681, Oct. 22, 1992, Pat. No. 5,211,298.

[51] Int. Cl.[6] ..... B65D 47/00

[52] U.S. Cl. ..... 215/229; 215/11.1; 215/388; 220/707; 220/709

[58] Field of Search ..... 215/1 A, 229, 11.1, 215/11.2, 11.3, 11.4, 11.5, 11.6; 220/705, 706, 707, 709, 710; 239/33

[56] References Cited

U.S. PATENT DOCUMENTS

| | | | |
|---|---|---|---|
| 1,253,579 | 1/1918 | Deanes . | |
| 2,052,496 | 8/1936 | Stassi | 65/13 |
| 2,655,279 | 10/1953 | Wolf . | |
| 2,868,203 | 1/1959 | Tichy | 128/252 |
| 2,877,917 | 3/1959 | Brooks et al. . | |
| 2,984,377 | 5/1961 | Biondi . | |
| 3,044,650 | 7/1962 | Oltion et al. . | |
| 3,059,797 | 10/1962 | Wilkinson et al. . | |
| 3,346,133 | 1/1967 | Herdman . | |
| 3,441,160 | 4/1969 | Levy . | |
| 3,517,884 | 6/1970 | Horvath | 239/33 |
| 3,547,296 | 12/1970 | Greenberg . | |
| 3,661,288 | 5/1972 | Noll . | |
| 4,448,316 | 5/1984 | Hiroshige . | |
| 4,557,392 | 12/1985 | Ryan et al. . | |
| 4,735,329 | 4/1988 | Le | 215/229 |
| 4,892,187 | 1/1990 | Stein | 206/217 |
| 4,898,290 | 2/1990 | Cueto | 215/11.1 |
| 4,923,083 | 5/1990 | Forbes | 220/90.2 |
| 4,940,152 | 7/1990 | Lin | 215/11.5 |
| 5,105,956 | 4/1992 | Tarng-Lin | 215/11.1 |

FOREIGN PATENT DOCUMENTS

| | | |
|---|---|---|
| 2630415 | 1/1978 | Germany . |
| 3407733 | 9/1985 | Germany . |

*Primary Examiner*—Allan N. Shoap
*Assistant Examiner*—Nove Stuckes
*Attorney, Agent, or Firm*—Panitch Schwarze Jacobs & Nadel

[57] ABSTRACT

Drinking devices include at least a drinking tube, a container lid and/or a container. The drinking tube includes a first free end located proximal a mouth of the container or the lid. At least a portion of the drinking tube, which is in or is intended to be placed in a container, is looped and is sufficiently flexible so as to tend to collapse under its own weight to open or close the individual loops and to permit at least a second free end of the drinking tube to drop to the lowest point within the container, regardless of the orientation of the container. A variety of specific configurations are disclosed for sports drink containers, infant nursing bottles, and drink bottles, cups, cans and other liquid containers for a variety of uses.

15 Claims, 8 Drawing Sheets

DRINKING DEVICES

RELATED APPLICATION

This application is a continuation-in-part of application Ser. No. 07/965,681, filed Oct. 22, 1992, now U.S. Pat. No. 5,211,298, which is incorporated by reference herein.

FIELD OF THE INVENTION

The invention relates to drinking devices, particularly bottles, glasses or other containers equipped with a straw or other drinking tube.

BACKGROUND OF THE INVENTION

It has been known for some time that a nursing bottle may be used by an infant in an upright position by the provision of a drinking tube. The drinking tube of such bottles extends from the nipple end of the bottle axially the length of the bottle to its bottom. However, in many such bottles, for example, those disclosed in U.S. Pat. Nos. 2,655,279; 2,868,203; 2,877,917; 2,984,377; 3,346,133; 3,441,160; and 4,557,392, the drinking tube is sufficiently rigid that the innermost end of the drinking tube remains close to the bottom of the bottle so that liquid cannot be drawn from the tube when the bottle is inverted and can allow the infant to draw in air, causing colic.

U.S. Pat. No. 3,059,797 discloses an infant nursing bottle which allows liquid to be drawn through the nipple whether the bottle is held up or inverted. However, it uses a complicated design with plural float valves which would be expensive to manufacture and require careful maintenance and cleaning.

U.S. Pat. No. 3,044,650 discloses a nursing bottle having a flexible tube which will fold upon itself when the bottle is inverted. Unfortunately, due to the relatively narrow bore of conventional nursing bottles, such collapsible drinking tubes must be so collapsible to fold upon themselves that they inevitably buckle and crease. U.S. Pat. No. 3,547,296 thought to avoid such a problem by providing a reinforcing spring to widen the bend of the drinking tube to prevent collapse of the tube wall. However, such a device is relatively complicated to manufacture and the coil spring provided would be a source of cleaning and maintenance problems.

Other drinking devices would also benefit from the ability to supply liquid to a drinker regardless of the orientation of the device. For example, the present invention would be quite useful in the medical/health care field for giving liquids to aged individuals, individuals with physical limitations, etc. Also, joggers' or bikers' bottles or the like may or may not be provided with a drinking tube. Some of the limitations of infant nursing bottles can be avoided by making the container portion of the device flexible so that the user can squeeze the container to expel liquid as well as pour or draw liquid with a drinking straw from an upright container. The drawback of such containers is that it is sometimes difficult to control the degree to which the container is squeezed when using the container while exercising. Also such containers are usually so readily flexible that accidental expulsions can occur, sometimes just while handling a full container. Further, once the container is about one-half to two-thirds empty, it is difficult to compress the container sufficiently to expel fluid. Stiff and/or large containers may be too difficult for children and many adults to squeeze at all. If equipped with bendable drinking straws or such straws with springs as disclosed in U.S. Pat. Nos. 3,044,650 or 3,547,296, such drinking devices would still suffer from the same infirmities indicated above for nursing bottles. Since joggers' and bikers' bottles are often used while exercising, stiff walled bottles lacking straws or tubes can be dangerous to use as they may have to be tipped up to disperse liquid and could block the user's vision.

Still other drinking devices include drinking tubes for various other reasons. For example, U.S. Pat. Nos. 4,448,316, 4,735,329, 4,892,187 and 4,923,083 all disclose containers with pop-out drinking tubes which permit easy access to the protruding end of the tube when the container is opened. U.S. Pat. Nos. 4,735,329 and 4,923,083 both disclose coiled, resiliently springy drinking tubes. U.S. Pat. No. 4,892,187 discloses a buoyant or float-equipped flexible drinking tube. U.S. Pat. No. 4,448,316 discloses the use of a spring member to bias flexible drinking tube from the mouth of the container. Each of these devices suffers the drawbacks of conventional drinking straws when used with containers in that each device can only be used to draw fluid from the container when the container is held in an upright orientation.

None of the aforesaid references discloses drinking devices which are optimally suited for dispensing liquid in virtually any orientation of the device.

SUMMARY OF THE INVENTION

It is an object of the present invention to provide a drinking tube equipped drinking device which overcomes some or all of the shortcomings of prior rigid and prior flexible drinking tubes.

It is a further object to permit liquid to be drawn from a container with a drinking tube in virtually any orientation of the container.

It is yet a further object of the invention to provide drinking devices which may be releaseably coupled with a conventional container to contain a disassembleable drinking device.

It is yet another object of the invention to provide a drinking device which permits a drinking tube to be extended from any portion of a sealed container and to draw liquid from the container in any orientation of the container.

In one aspect, the invention is a drinking device comprising a container and a drinking tube, the container having a base, an upper end opposing the base, and interior and mouth providing access to the container interior. The drinking tube has opposing first and second open ends, the first end being held at least proximal the container mouth and at least part of a remaining portion of the drinking tube extending away from the first end in loops extending more than once completely around within the container interior, the second end of the drinking tube being located proximal to the base when the device is supported in an upright position on the base and proximal the upper end of the container when the device is supported in an inverted position with the upper end down and at least the loops of the remaining portion of the drinking tube being sufficiently flexible to freely collapse and extend axially at least under the weight of the remaining portion of the drinking tube. The remaining portion of the drinking tube is sufficiently resilient to resist collapse of its side wall and to remain in a looped condition both when the remaining portion has collapsed axially upon itself and when the remaining portion has extended axially away from the first end.

In another aspect, the invention is a drinking device comprising a container lid and a drinking tube. The lid has a central portion with opposing first and second major sides and a skirt extending in an axial direction away from one side of the central portion around a periphery of the central portion. The drinking tube is secured with the lid and has opposing first and second open ends, the first end defining an opening through the lid on the second side of the central portion and at least part of a remaining portion of the drinking tube extending away from the lid and the first end in a loop of more than one revolution, at least the loop part of the drinking tube being sufficiently flexible such that each loop formed by the part freely collapses and extends in the axial direction at least under the weight of the remainder of the drinking tube. At least the loop part of the remaining portion of the drinking tube is sufficiently resilient to resist collapse of its side wall and to remain in a looped condition both when the remaining portion has collapsed axially upon itself and when the remaining portion has extended axially away from the first end.

In yet another aspect, the invention is a drinking device comprising a container and a drinking tube. The container has a base, an upper end opposite the base, an interior and a mouth providing access to the interior. The drinking tube has first and second opposing open ends, the first end of the drinking tube being supported at least proximal the container mouth, and a remaining portion of the tube being positioned within the container interior and having a length sufficiently greater than a maximum dimension of the chamber interior such that at least part of the remaining portion of the tube must return upon itself in the container interior and at least the returning part of the tube being sufficiently flexible so as to freely collapse and extend in an axial direction of the container, at least under the weight of the remaining portion of the drinking tube.

In another aspect, the invention is a drinking device comprising: a container; a drinkable liquid in an interior of the container; a solid closure releasably sealing and opening of the container, the closure having an inner side facing into the container interior; and a drinking tube in the container releasably secured with and supported from the closure on the inner side of the closure.

BRIEF DESCRIPTION OF THE DRAWINGS

The foregoing summary of the invention and following detailed description of preferred embodiments will be better understood when read in conjunction with the appended drawings. Although preferred embodiments are shown in the drawings, it should be understood that the invention is not limited to the precise arrangements and instrumentalities shown. In the drawings, which are all diagrammatic.

DETAILED DESCRIPTION OF PREFERRED EMBODIMENTS

Figure 1:
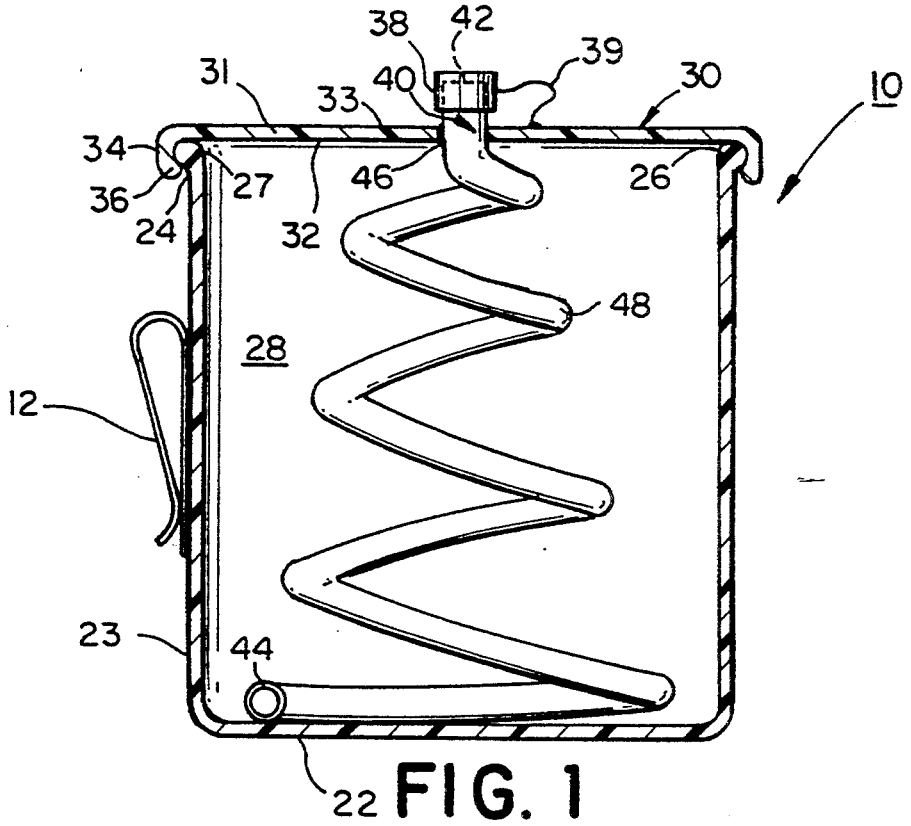
FIG. 1 is a partially broken away side elevation of a first embodiment drinking device of the present invention.

In the drawings, like numerals are employed for the indication of like elements throughout.

Figure 2:
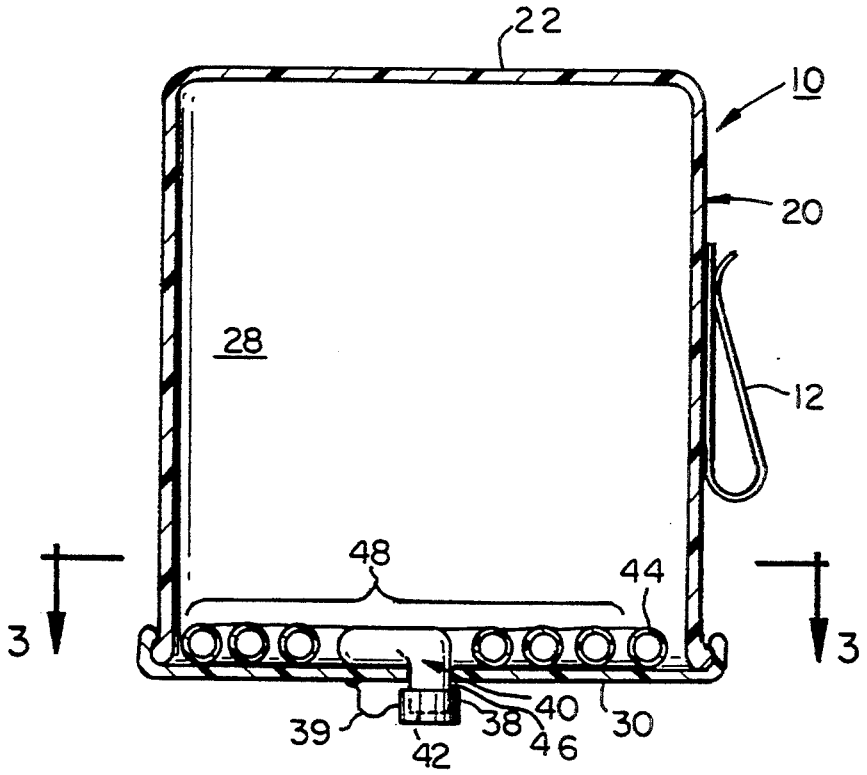
FIG. 2 is a partially broken away side elevation of the drinking device of FIG. 1 in an inverted orientation.
Figure 3:
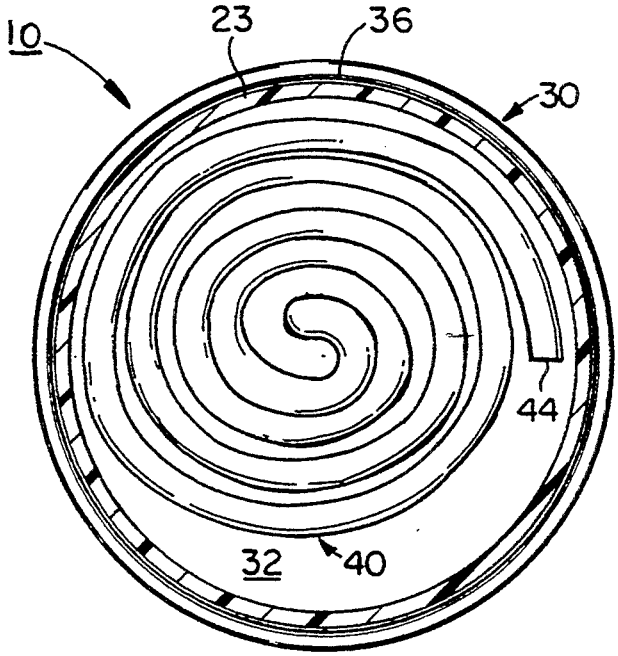
FIG. 3 is a sectioned plan taken along the lines 3—3 of FIG. 2.

A first embodiment drinking device of the present invention is indicated generally at 10 in FIGS. 1–3. Device 10 includes a container indicated generally at 20, a lid indicated generally at 30, and a drinking tube indicated generally at 40. The container has a base 22, a side wall 23 extending generally away from the base 22 in an axial direction, the end of the side wall 23 remote from the base defining a remote or upper end 24 of the container 10, opposite the base 22 and a mouth 26 which provides access to the container interior indicated generally at 28. A clip 12 may be mounted on the sidewall 23 to permit the device to be carried on a belt or on the waistband of a garment.

Lid 30 includes a central annular portion 31 and a skirt 34 extending axially away from one side of the central portion around the outer periphery of the central portion 31. The central annular portion 31 has opposing first and second, inward and outward facing major sides, 32 and 33 respectively. The skirt 34 is configured to sealingly mate with the upper end 24 of the container. Any conventional container sealing configuration may be employed. A snap configuration is depicted on the container in FIGS. 1–3 where a bead 27 is formed by an outward thickening of the side wall 23 around the mouth 26 while an inward extending bead or ridge 36 is provided at the extreme end of the skirt 34 remote from the central portion 31 of the lid 30 and overlapping the container bead 27. A threaded engagement, a bayonet engagement, a closely dimensioned frictional engagement or other combined frictional and interference engagements, like the snap bead arrangement shown in FIGS. 1–3, can be employed, as desired, to sealingly fit a selected lid to the mouth of a selected container.

Drinking tube 40 preferably includes a first generally straight tubular portion 46 and a second generally looped and preferably spirally wound tubular portion 48. A first open end 42 of drinking tube 40 extends through and protrudes from the outer facing side 33 of the lid 30, which supports the first end 42 proximal the container mouth 26. The remaining portion of the tube 40 within the container interior is much longer than the maximum dimension of the interior and must return upon itself in a plurality of loops in order to fit within the interior. A second, opposing free open end 44 of the drinking tube 40 may be weighted in some suitable fashion, for example by enlargement of that end of the tube 40 itself, if the tube material is sufficiently denser than the liquid to be contained in the device, so that the second end 44 will drop to the lowest point in the container interior, regardless of the container orientation. Alternatively, one or more separate weight members can be applied to, incorporated within, or otherwise secured to the second free end 44 of the drinking tube 40.

As is best seen in FIG. 1, the tube 40 returns upon itself, preferably in a plurality of complete spiral loops around the container interior 28. While approximately three and one-half complete loops are shown, a greater or lesser number might be used, as desired and as dictated by physical constraints. Preferably, only enough remainder of the tube 40 is provided to reach all areas within the container interior 28. While spiral (i.e. varying radii) loops are shown, it will be appreciated that tube 40 could be made to return upon itself, or be able to return upon itself, in other configurations, for example in a series of fan-like pleats or helical (constant radius) loops. Preferably the loop portion 44 is sufficiently resilient or rigid so that loops are maintained in the tube, regardless of its orientation or the orientation of the device 10 and its side wall does not collapse cross sectionally and close the tube, but is sufficiently flexible so that the loops are not self-supporting in an axial direction. Consequently, when the device 10 is oriented in an upright position as shown in FIG. 1, the loops of portion 44 freely collapse axially (i.e., in an axial direction of the loops) with second end 44 ultimately supported by the inner facing surface of base 22. In particular, the loops of portion 48 extend axially to drop the second end 44 of the drinking tube 40 onto the inner facing surface 32 the base 22, where it will remain immersed in any liquid provided in the container 20. However, When the drinking device 10 is inverted, as is depicted in FIG. 3, the remaining loop portion 48 is sufficiently flexible so that it freely collapses axially upon itself, or, stated another way, its loops collapse upon themselves within the container, at least under the weight of the remaining loop portion, towards the inner facing surface 32 of lid 30, preferably into a planar spiral where the second end 44 is again immersed in liquid in the container trapped against the lid 30.

Preferably, the first end 42 of the drinking tube 40 is fixedly secured with lid 30. While it may be possible to simultaneously form both the lid 30 and drinking tube 40 together, more typically at least the first end 42 would be passed through an opening provided in the central annular portion 32 of lid 30 and thereafter fixed to the lid 30 by suitable means such as thermal or ultrasonic welding, adhesives or other bonding methods. If desired, a mechanical securement can be made by means of a tight, friction fit or the provision of an annular fitting ring received in an opening of the lid, lapping both sides 32 and 33 and itself frictionally receiving the first tubular member 46. The container 20 can be made from a relatively rigid, non-collapsible material and the drinking tube 40 sealed with the lid 30 whereby the entire device 10 is sealed except for the opening provided through the drinking tube 40, which is the only unblocked opening through the lid. If desired, a tiny relief hole or a relief valve can be provided to permit air to enter the device when liquid is sucked through the drinking tube. Alternatively, the container can be made of flexible material so that, when the container 20 is squeezed, liquid is ejected from the device through the drinking tube 40. A relief valve would not be required in such a configuration. However, if desired, any of several different types of valves can be provided to permit air to pass through the lid 30 other than through the drinking tube 40. Preferably, a relief valve through the lid can be provided in the form of a small slit valve or by an opening with a resilient closure flap configured to operate as a check valve. Each of the slit valve and closure flaps would ordinarily be biased closed and would open when a sufficiently low partial vacuum is created within the container yet remain closed when the container is pressurized above that partial vacuum level. In contrast to tube 40 (with or without cap 38), each such valve would provide an intermittently blocked opening.

Figure 4:
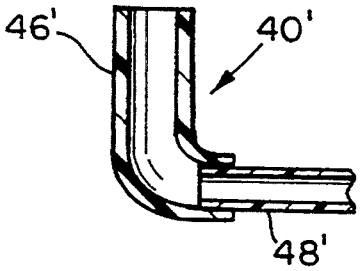
FIG. 4 depicts a different drinking tube construction.

The lid 30 and drinking tube 40 can be provided as a separate drinking device with the lid sized and configured to securingly seal to a standard size container, such as standard size beverage glass, coffee cup, etc. The drinking tube can also be of a two-piece construction as shown in FIG. 4 in which tube 40' is formed by a relatively short, rigid section 46' and the remainder is at least essentially provided by a second, flexible coiled tube 48' received in one end of and secured with tube 46'.

Figure 5:
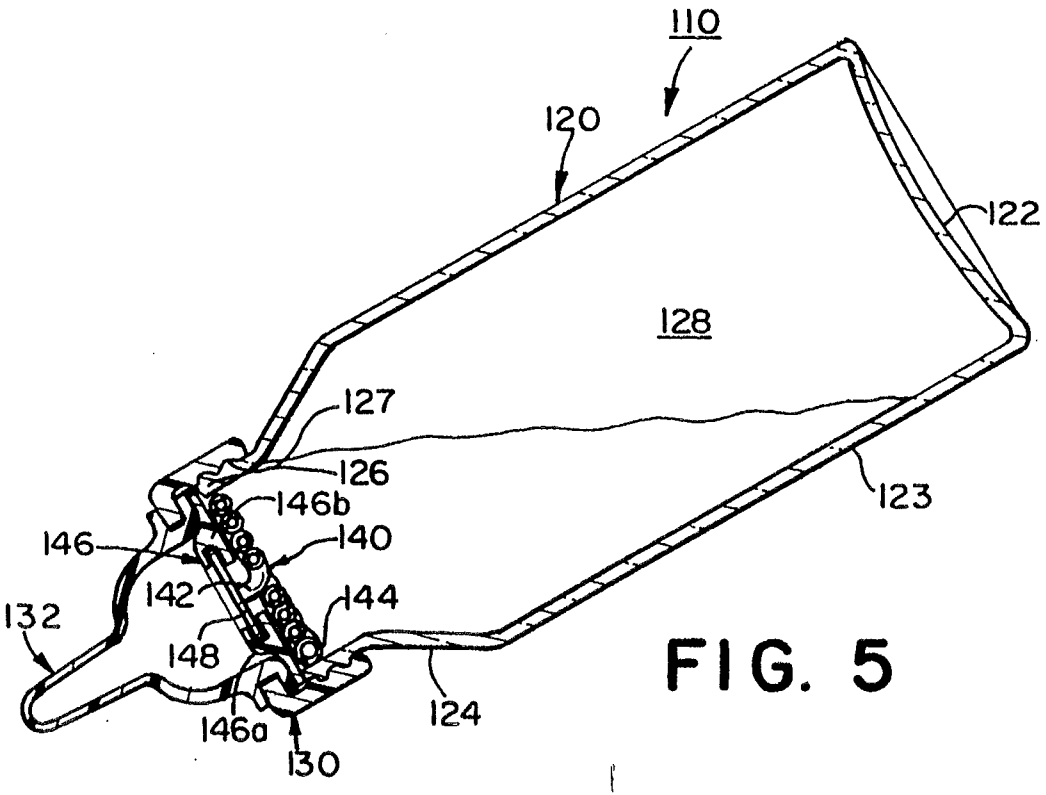
FIG. 5 is a sectioned side elevation of a second embodiment drinking device of the present invention in the form of the nursing bottle.
Figure 6:
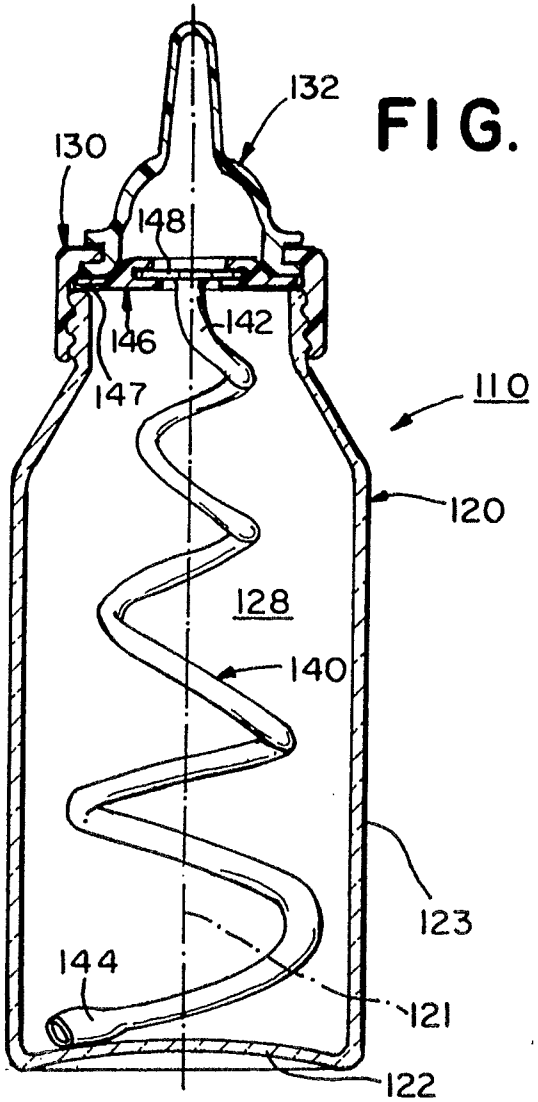
FIG. 6 is a sectioned side elevation of the device of FIG. 5 in a different orientation.

FIGS. 5 and 6 depict a second alternate drinking device, indicated generally at 110, in the form of an infant nursing bottle. Except for the incorporation of a second embodiment drinking tube 140, nursing bottle 110 is entirely conventional and includes a glass or plastic container 120 having a base 122, a side wall 123 extending away from the base 122 around its periphery and necking down to a mouth 126 at an upper end 124 of the bottle itself. Device 110 further includes a conventional, annular, threaded lid 130, which is received on threading 127 around the neck of the bottle 120. A conventional nursing nipple 132 is received in conventional fashion in the central opening of the annular lid 130. A first end 142 of drinking tube 140 is held centered in the mouth 126 of the bottle 120 by means of a swivel 146 with opposing first and second major sides. The first end 142 of the drinking tube 140 preferably includes an annular flange 148, which is journaled in the swivel 146 between an annular base portion 146*b* of the swivel and an annular retainer portion 146*a*, which projects upwardly from the base portion 146*b* and extends around the annular flange 148. Swivel 146 permits drinking tube 140 to rotate about a central longitudinal axis 121 of the drinking device 110. A radial groove 147 can be provided on the lower side of the swivel to permit air to bleed into the container 120. A remaining portion of the drinking tube 144 at least loops and preferably spirals away from the first end 142 and center line 121. While four complete loops are illustrated, a greater or lesser number may be provided. Again, a second, free open end 144 of the drinking tube 140 is preferably weighted by being enlarged to assure that the second free end 144 migrates to the lowest portion of the container 120, regardless of its orientation.

Preferably, the drinking tube 140 is formed so as to tend to lie in a planar spiral against a lower side of the swivel 146 when the bottle 120 is rotated more than about ninety degrees from an upright orientation. Preferably too, the swivel 146 permits the entire drinking tube 140 to rotate so that the weighted second end 144 will always move toward what is the lower most portion of the interior 128 of the bottle. In the upright position of the device 110, illustrated in FIG. 6, the drinking tube 140 collapses axially away from the first end 142 to the base 122 of the bottle 120.

It will be appreciated that other means and arrangements can be provided to swivelly support the first end 142 of the drinking tube 140 and that, if desired, a swivel arrangement could be done away with entirely by making the drinking tube 140 sufficiently flexible and the second free end 144 sufficiently weighted and/or large such that the second end 144 will tend to fall to the lowest point in the bottle 120, regardless of the bottle's orientation and/or not tend to nest as part of the planar spiral shown in FIG. 5, which might tend to trap end 144. It will further be appreciated that the drinking tube 140 of the second embodiment 110 might be Substituted for the tube 40 of the first embodiment 10 and vice versa. Lastly, if desired, a check valve can be provided at or proximal the swivel in the manners disclosed in several of the previously cited prior art patents, all which are incorporated by reference herein.

Figure 7:
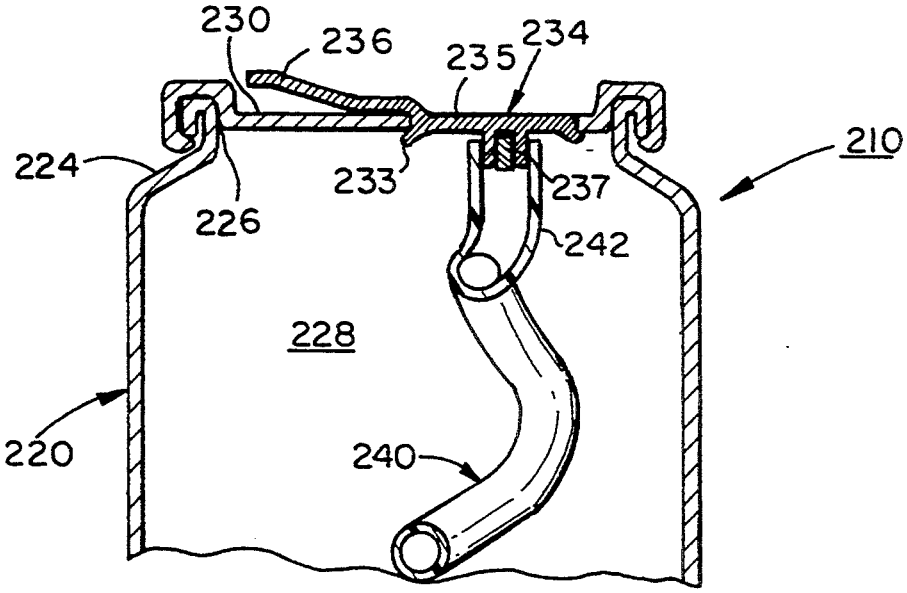
FIG. 7 is a partially broken away side elevation of a third embodiment drinking device of the present invention utilizing a pop-top can.

FIG. 7 depicts diagrammatically yet a third embodiment drinking device of the present invention, indicated generally at 210, in the form of a generally conventional metal beverage can with a container or cup portion 220 and a rolled metal lid 230. Lid 230 seals a mouth 226 of the container 220 at an upper end 224 of the container opposite the container base (not depicted). The lid 230 includes a modified pull tab sealing closure 234 which is sealingly received in a conventional fashion in an aperture 233 provided in the lid 230. The closure 234 includes a seal portion 235 actually received in the lid aperture 233, a finger tab 236, which is integral with the seal portion 235 and which projects away from the lid 230 to permit gripping of the closure 234, and a retainer plug 237, which preferably projects generally perpendicularly inwardly from the seal portion 235 towards the interior 228 of the container 220, releasably securing a first end 242 of a spiral drinking tube 240, only part of which is indicated in the figure. Tube 240 preferably is in the form of an increasing spiral similar to the drinking tube 240 of FIGS. 5 and 6. Preferably the first end 242 of drinking tube 240 is pressed over the retainer plug at 237 and releasably held on the plug by means of friction and/or mechanical interference engagement, or through a consumable adhesive such as gum arabic. When the closure 234 is removed from the device 210, the first end 242 of the drinking tube 240 is removed with the closure 235. The consumer then removes the tube 240 from the plug 237 and can use the tube 240 as a drinking straw.

Figure 8:
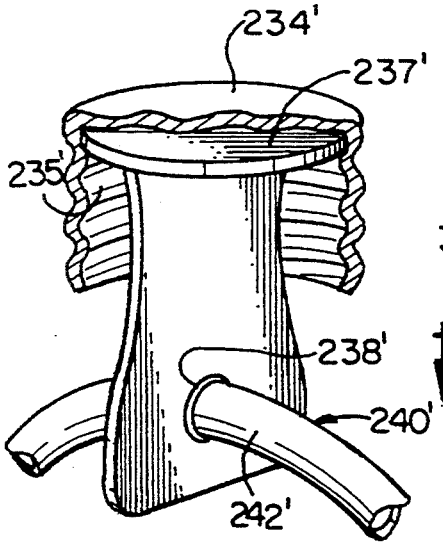
FIG. 8 is a partially broken away perspective of a fourth embodiment drinking device for use with a container such as a soft drink bottle having a threaded neck.

FIG. 8 depicts an alternative mounting of a drinking tube 240' directly with a releasably sealing solid closure such as a twist-off cap 234' in which a tab 237' is provided on an inner side 235' of the cap 234' which faces into the interior of the bottle or other container on which the cap 234' is mounted. Tab 237' includes an opening 238' which releasably receives and supports the first end of the drinking tube 240' in the interior of the container receiving the cap 234'. Tube 240' could be provided with corrugations, flexible ridges or other features(not depicted) at the first end 242' to permit the tube to bend tightly around the tab 237' without folding and creasing. Tube 240' is otherwise preferably provided as a plurality of axially collapsing and extending loops like the other tubes. This embodiment has application in both metal and plastic caps and to conventional pry-off as well the more popular, twist-off caps depicted. Tab 237' can be fixedly secured with the cap 234' in a variety of ways including making the tab of a sufficient diameter so that it threads into the cap or by adhesives or other forms of bonding. Alternatively, the tab 237' could be formed integrally as part of the cap 234' or comparable closure. All relevant elements, namely the drinking tube 240' and its holder 237' are located within the container before use and can be returned to the container if only partially used. This embodiment eliminates human handling of unwrapped or unprotected drinking straws and elimination of the bother and litter associated with paper wrappings on such straws. Also, this embodiment of the invention may be used with relatively straight, conventional drinking tubes or very soft, pliable tubes or with tubes optimized in design for this particular use, e.g., a once-folded tube designed to spring back to a straight tube when removed from the container.

Figure 9:
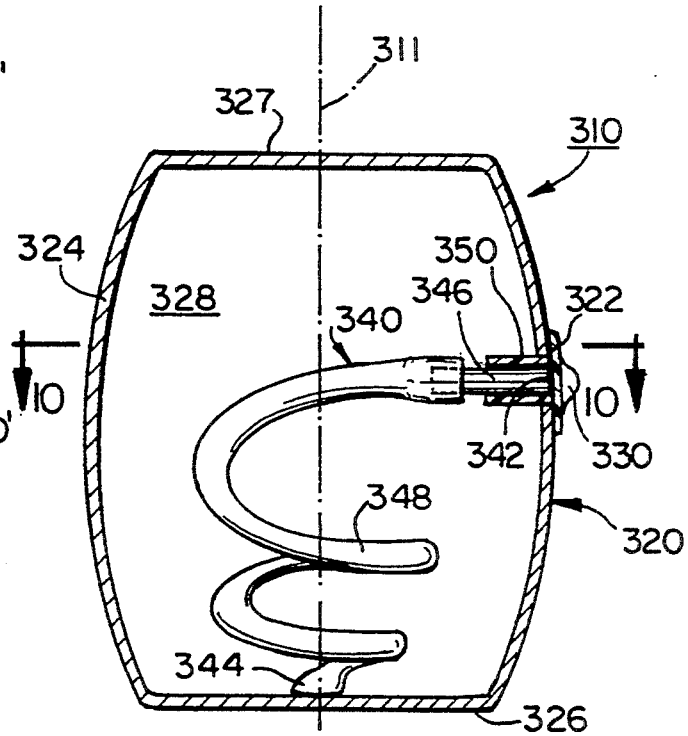
FIG. 9 is a partially broken away side elevation of a fifth embodiment drinking device of the present invention.
Figure 10:
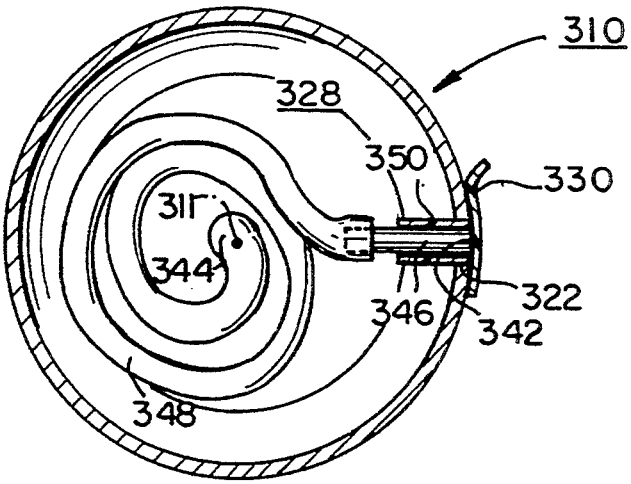
FIG. 10 is a sectioned plan taken along the lines 10—10 in FIG. 9.
Figure 11:
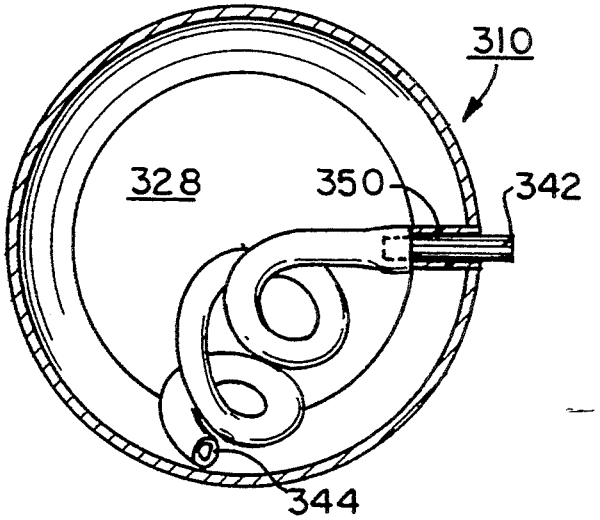
FIG. 11 is a partially broken away side elevation of the device of FIGS. 9 and 10 after rotation onto its side.

FIGS. 9 through 11 depict diagrammatically yet a fifth embodiment novelty drinking device indicated generally at 310. The device 310 includes a generally barrel-shaped container 320 having but a single opening 322 in a side wall 324 of the container. Opposing ends 326 and 327 of the container 320 are flat so that the device 310 may be supported on either end. A drinking tube 340 is provided within the container. A first end 342 of the drinking tube is supported immediately inside the single opening 322 by an elastic material sleeve 350. Sleeve 350 is stretched and held in the stretch position by a releasable seal 330, which is provided on the outside of the container 320 covering the opening 322. Sleeve 350 is secured at one end to the side wall 324 (outer or inner facing side) and at an opposing end to the first end 342 of the tube 340. When the seal 330 is removed, as is indicated in FIG. 11, the sleeve 350 contracts and relaxes projecting the first end 342 of the drinking tube 340 through the opening 322.

Drinking tube 340 can be of a two-piece construction as indicated including a short, substantially rigidly resilient, first tubular member 346, which partially projects through the single opening 322 when the seal 330 is removed, and a second, more flexible tubular member 348, which is looped and, preferably, formed into a decreasing planar spiral. A free end of the second member 348 constitutes a second open end 344 of the drinking tube 340 and is again preferably weighted. The second tubular member 348 is preferably sufficiently flexible so as to tend to collapse under its own weight both in the axial direction, along a vertical center line 311 of the device 310 in FIG. 9, for example, and, preferably, in a radial direction as well, for example in the manner shown in FIG. 9 so that liquid can be drawn from the device 310 in virtually any orientation of the container 320. The second weighted end 344 tends to lie along the center line 311 of the container 320, regardless of which flat end 326 or 327 the container is supported on. Alternatively, device 310 may be provided with a tab seal like 234 or 234' and sleeve 350 eliminated. The substituted tab seal would be used to pull a first end of a drinking tube from the container when the tab is removed. Storing the drinking tube in a closed or sealed container in the foregoing manner assures that the tube remains sanitary and eliminates the waste of a disposable cover for the tube. The foregoing construction further lessens if not eliminates the likelihood of injury should a sharp edge or surface remain where any of the seals were removed.

Figure 12:
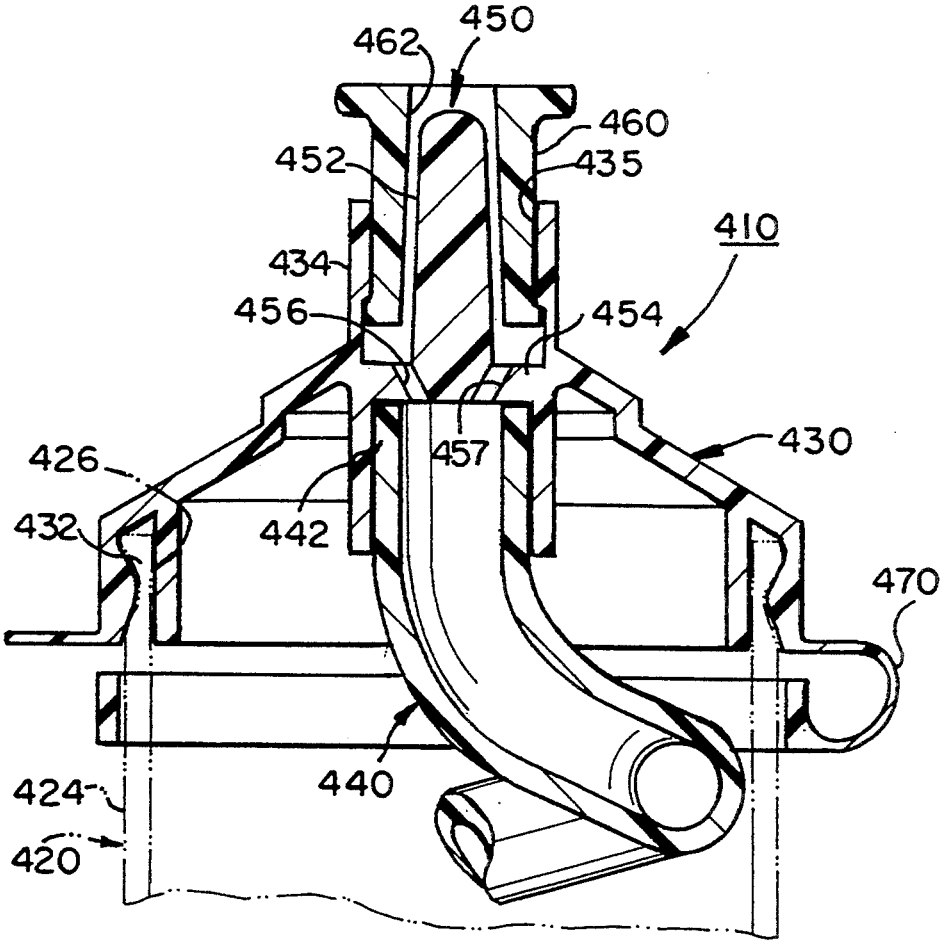
FIG. 12 is a broken away side elevation of yet a sixth embodiment of the present invention in the form of a combined lid and drinking tube.

FIG. 12 depicts a combined removable container lid and drinking tube embodiment indicated generally at 410, which may be snap-fitted over the mouth of an appropriately sized mating container (not depicted). Device 410 includes a lid portion indicated at 430 with opposing first and second major sides and a coupled drinking tube portion 440. An annular channel 432 of the lid 430 receives and snaps over a suitably sized and configured container mouth (not depicted). An axially extending tubular portion 434 defines a central passage 435 with a center post 450. Center post 450 has a tapered outer surface 452 extending axially upwardly from a base 454 spanning the passage 435. Passages 456 and 457 are provided through the base 454 on either side of the tapered surface 452. A tubular closure member 460 is also slidably received in the bore 435 and includes an inner tapered surface 462 having the same degree of taper as does the outer surface 452 of the center post so as to seal the central passage 435 when the closure member 460 is pressed into the passage 435 to rest on the base 454 of the center post 450. The first end 442 of drinking tube 440 is preferably fixedly secured in the remaining open end of the lid tubular portion 434 and fluidly couples the passages 456, 457 through base 454 with the interior of the container. Tube 440 is again preferably looped upon itself a plurality of times and is sufficiently flexible to axially extend or collapse, depending upon the configuration of the container on which device 410 is mounted. If desired, a separate, additional mounting ring 470 can be molded to the lid 430 to hold the lid 430 on a container, even when the lid has been removed from the container. Also, if desired, the base 454 and center post 450 can be formed as a separate member which is forced into the passage 435 in the manner of the integral construction shown or which is wedged into the first end 442 of tube 440 and used to fixedly secure both the center post/base member 450 and tube 440 in the passage.

Figure 13:
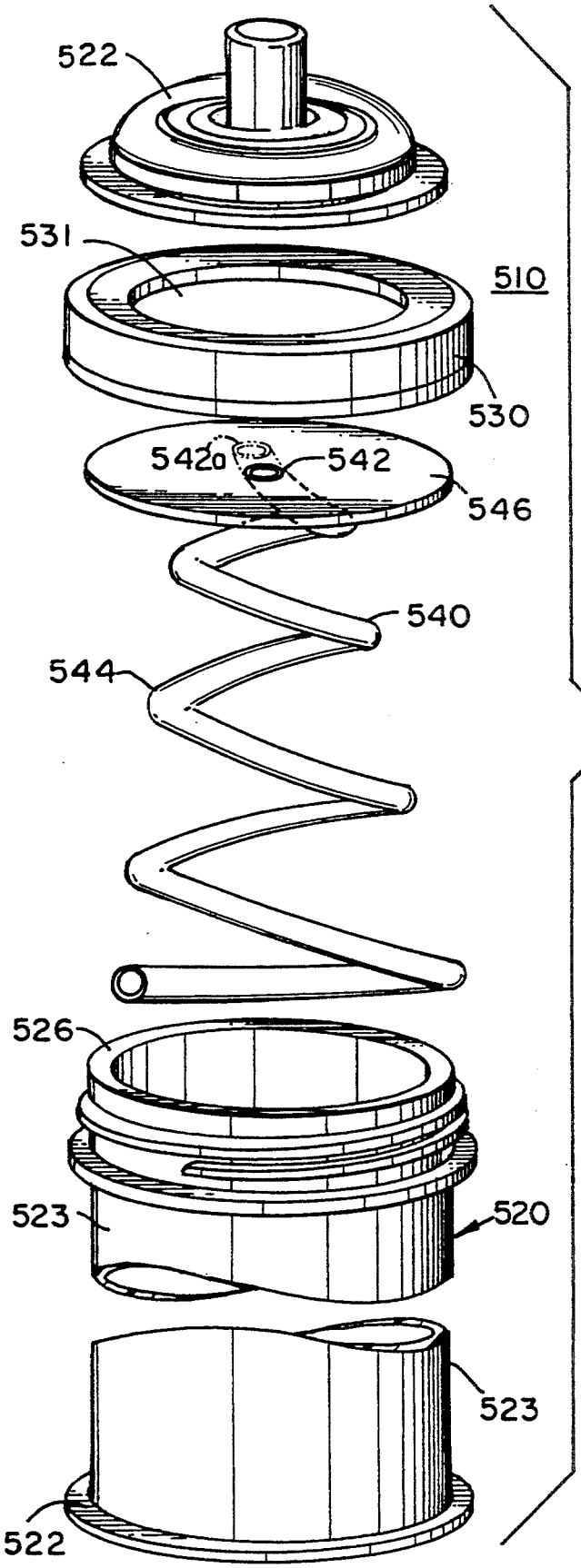
FIG. 13 depicts an exploded form yet another embodiment drinking device of the present invention in the form of a modified nursing bottle.

FIG. 13 depicts an exploded form yet another nursing bottle embodiment of the present invention indicated generally at 510 which includes a glass or plastic cylindrical or nearly cylindrical container 520 having a base 522, a wall 523 extending generally perpendicularly away from the base around its periphery to a mouth 526 approximately the same size as the base. The sidewall 123 is preferably provided with threading or other suitable mating structures on its outer surface approximate amount 526. An annular lid 530 is provided with mating, threading or other structures along its inner circumferential surface could be removably secured to the mouth 526. A nursing nipple 522, which is enlarged compared to the conventional nursing nipple 132 but still similar in size to other commercially available nursing nipples, is preferably received in a conventional fashion in the central opening 531 of the annular lid 530. A first end 542 of drinking tube 540 of the present invention is supported in the mouth 526 of the bottle 120 by means of a lid 546 with opposing first and second major sides. Unlike swivel 146, lid 546 simply receives and stationarily supports the first end 542 of the drinking tube 540. The first end 542 of the drinking tube may terminate at the lid 546, as depicted in solid, or may be extended through the lid, as is indicated in phantom in FIG. 13 at 542*a*. Also, the center line of the first end 542 of the tube may be oriented perpendicularly to the lid, as was the center line of the first end 142 of tube 140 or coupled to or passed through the lid non-perpendicularly, an angle generally continuing the spiral of the tube. Again, the remainder of the tube extending away from the first end 542 freely collapses to the base 522 of the container 520 when the bottle 510 is in the upright position indicated generally in FIG. 13 and collapses towards the side of the lid 546 facing into the container 520 when the bottle is generally inverted, preferably but not necessarily assumed to be a spiral orientation much like the tube 44 in FIG. 2 of that embodiment, against the inner facing wall of the lid 546. Again, the second, remaining, free end of 544 of the tube is appropriately weighted to cause the extreme free end 544 to fall to the lowest point within the container 120, regardless of its orientation. The depicted non-swivel mounting of the first end 542 of the tube 540 and the pitching of the center line of the first end 542 of the tube from the perpendicular with respect to the lid 546 are all believed to simplify manufacture, use and cleaning. Furthermore, the enlargement of the mouth end of the nursing bottle 510, by elimination of the necking, is supposed to more accurately simulate a women' breast and provide a larger surface against which the tube 540 may stack on the lid 530.

Figure 14:
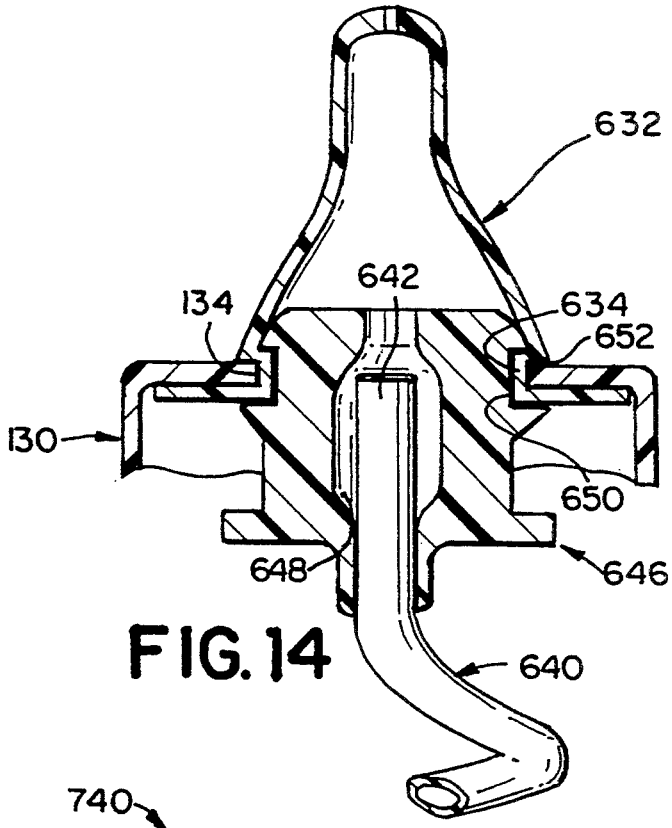
FIG. 14 depicts yet another mode of coupling a drinking tube of the present invention with the nipple of a nursing bottle.

FIG. 14 depicts yet another drinking tube embodiment of the present invention used with a nursing bottle. A first end 642of a drinking tube 640 of the present invention is secured directly with a nipple 632 through a hollow plug member 646 with opposing first and second major sides and a central opening 648 which receives the first end 642 of an otherwise conventional drinking tube 640 of the present invention. Plug member 646 is provided with a circumferential groove 650 which receives and engages an inwardly projecting, circumferential ridge 634. Ridge 634 is conventionally provided in nipples 632 so as to define a groove 652 on the outer circumferential surface of the nipple which seats upon and engages the inner peripheral edge portion 134 of a conventional lid 130. Plug member 646 is preferably resilient and even somewhat elastic to seat well in the nipple 632. The first end 642 of the drinking tube 640 is preferably only frictionally secured by the preferably resilient material of plug 646 so that the tube 640 may be readily removed for cleaning. It will be appreciated that a check valve, for example, a resilient flap, can be provided at the mouth of opening 648 facing into the nipple 632, if desired.

Figure 15A:
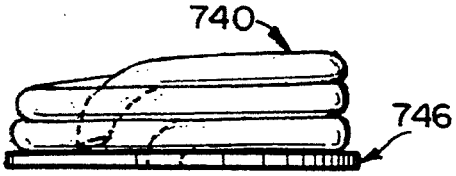
FIGS. 15(*a*) and 15(*b*) are side elevational views of yet another drinking tube embodiment of the present invention collapsed upon itself and away from its first end, respectively.
Figure 15B:
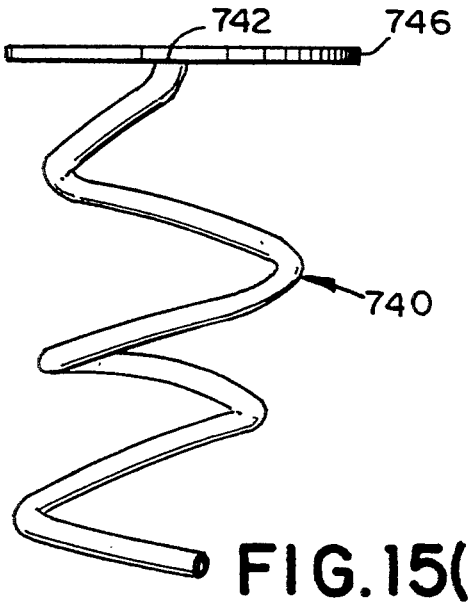

FIGS. 15(*a*) and 15(*b*) depict a drinking tube 740 of the present invention secured with an exemplary lid 746 with opposing first and second major sides and indicate a helical (constant radius type spiralling) drinking tube of the present invention which is collapsed upon itself in FIG. 15(*a*) and which is collapsing away from its first end 742 secured to the lid 746 in FIG. 15(*b*).

Figure 16A:
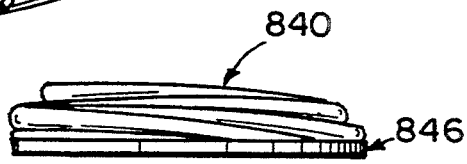
FIGS. 16(*a*) and 16(*b*) are side elevational views of yet another drinking-tube embodiment of the present invention collapsed upon itself and away from its first end, respectively.
Figure 16B:
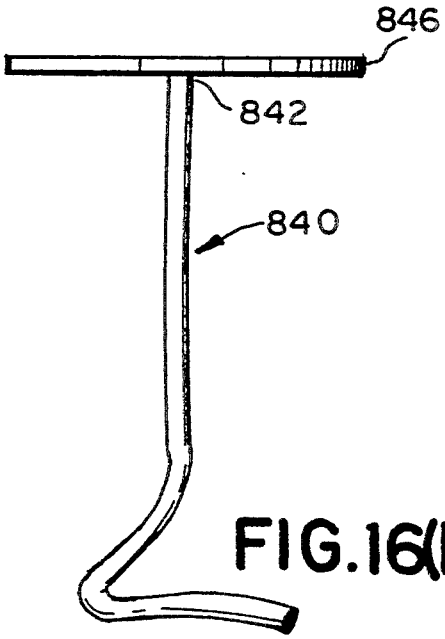

FIGS. 16(*a*) and 16(*b*) depicts an entirely different drinking tube embodiment, indicated generally at 840 which is secured with an exemplary lid 846 with opposing first and second major sides. In this embodiment, tube 840 is of a relatively small diameter and sufficiently soft so as not be self-supporting in an axial direction so that the tube readily collapses upon itself as depicted in FIG. 16(*a*) and away from itself as depicted in FIG. 16(*b*). Tube 840 is not sufficiently resilient to maintain itself in loops when falling axially away from its first end 842 (FIG. 16(*b*)) or to ensure that it will collapse in predetermined loops upon itself (FIG. 16(*a*)) as have the other disclosed embodiments. However, such tubes 840 will be provided sufficient rigidity and resiliency, for example, but being of a small diameter but with a relatively thick, flexible wall, to assure that the tube 840 will not fold or crease cross sectionally when collapsing upon itself at the position shown at FIG. 16(*a*).

Figure 17:
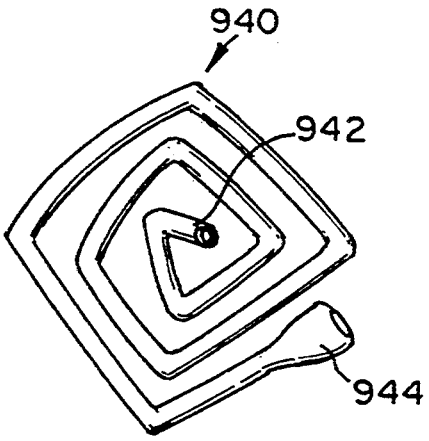
FIG. 17 depicts yet another drinking tube embodiment of the present invention in a top plan view.

FIG. 17 is a top plain-view of another drinking tube illustrating another type of resilient looping in which the tube does not extend in a curvilinear path but rather in a series of sequentially connected straight segments forming polygonal "loops". Nor are the loops limited to the specific number of polygonal sides or relative length of the segments shown. It will be appreciated that a composite tube can be used in which the remaining portion of the tube extending from the first secured end is relatively rigid and yet collapsible upon itself and away from the first end when inverted, and an even more flexible, weighted second end, which is capable of collapsing in the lowest point of the container in which it is used regardless of how the intervening straight sections of the drinking tube may stack upon themselves.

Figure 18A:
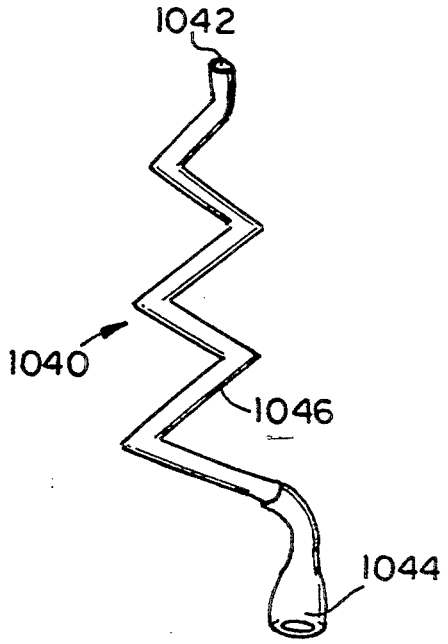
FIGS. 18(*a*) and 18(*b*) are side elevational views of yet another drinking tube embodiment of the present invention collapsed away from its first end and upon itself, respectively.
Figure 18B:
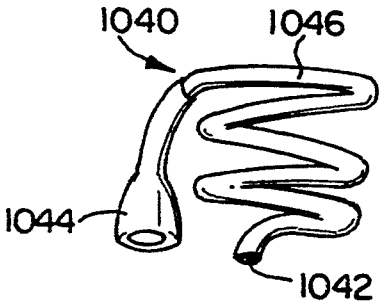

This is depicted in FIGS. 18(*a*) and 18(*b*) where another drinking tube embodiment 1040 with first end 1042, a relatively soft, flexible or flaccid member 1044 defining an opposing, second end of the tube and an accordion or fan pleated intermediate section 1046, which connects the first end 1042 with the soft, flexible second end member 1044. Pleated section 1046 is sufficiently rigid to maintain a generally pleated configuration regardless of its orientation but may not be so rigid as to maintain itself in a vertical plane when inverted into the position shown in FIG. 18(*b*) so as to collapse upon itself. The second end member 1044 is relatively more flexible and even less able to support itself and tends to simply droop from the coupled end of pleated section 1046 at the lowest point in the container. The flexibility of the accordion pleated section 1044 assists in collapsing to a more vertical orientation (FIG. 16(*b*)) or a more horizontal orientation (FIG. 16(*a*)) to reduce the bending required of end member 1044.

In terms of composite tubes, it will also be appreciated that composite tubes may be provided from two or more separate tubes or tube sections or by suitably treating a single monolithic tube. Further tubes of the present invention may be provided with a substantially rigid end loop or partial loop at the second, free end of the drinking tube which is preferably sized and shaped, for example, by having the greatest radius permitted by the container in which the drinking tube is used, to assure the free end rests on an appropriate surface of the container in a predetermined, desired manner.

Figure 19:
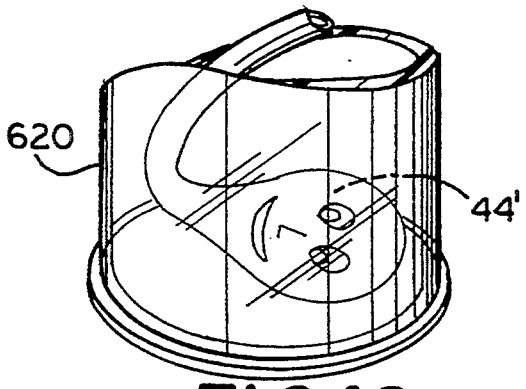
FIG. 19 depicts diagrammatically a decorated, weighted, extreme free end of the drinking tube.

FIG. 19 indicates yet another aspect of the invention, namely the use of the drinking tube in the present invention for entertainment purposes. This can be accomplished in a number of ways, including, but not limited to the coloration of the tubes use of fluorescent and/or multiple colors in solid or varying patterns, the decoration of second, free end of the tube 44' as shown in FIG. 19 with the face of the figure or the face or shape of another figure, animal, flower, entertainment character, etc. In particular, a tube may be colored black for black and white contrast with infants normally drinking milk, or of a primary color. Research shows that infants up to about three months of age are most responsive to black/white high contrast images and patterns, while those three to six months of age are most responsive to primary colors and images. Drinking tubes may also be made of colored material including bright, primary or fluorescent-colored material, to attract the eyes of and entertain children using the bottle or otherwise using the tube. Such coloration should also assist in monitoring the position and/or orientation of the drinking tube, its extreme free end, etc., should that be desired.

Figure 20:
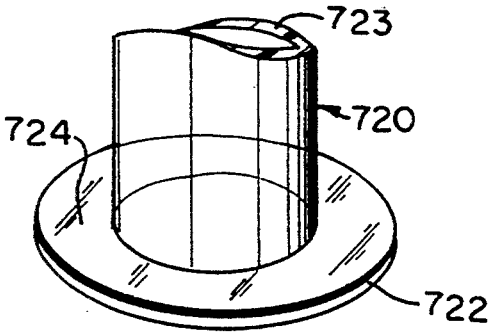
FIG. 20 depicts diagrammatically the base of yet another drinking container embodiment.

FIG. 20 depicts a preferred embodiment of another aspect of the invention, a drinking container modified to provide entertainment to the person using the container. Only the lower portion of container 720 is depicted, and it includes an enlarged base 722 with a rim portion preferably extending radially outwardly from the side wall 723 of the container 722. The upper portion of container 720 is conventional and may look like the upper portion of any of the previous containers 20, 120, 220, 320, 420 or 520, or any other conventional container which might be used for drinking or nursing. Preferably, a reflective coating 724, e.g., a thin aluminum layer, is applied to at least the enlarged rim area of the base 722 extending outwardly from the side wall 723 so that the individual using the container 720 is able to see his or herself reflected by the coating 724 while drinking from the container 720. While at least the projecting rim portion receives coating 724, it will be appreciated that the central portion of the base 722, which is surrounded by side wall 723, can additionally or alternatively be provided with the reflective coating. While the base 722 of container 720 is preferably flat, the rim portion or central portion of the base 722, or both, may be curved to enhance the entertainment value, for example, to provide a magnified or panoramic reflection or to reflect the drinking tube and the interior of the container 720 to the user.

The container 720 may be metallized directly or may receive an adhesive-backed metal coated transfer foil. Such foils come in a variety of colors. Other types of foils may also be mounted to the base to be viewed by the child using the bottle. In particular, foils can be provided with stamped images and even three-dimensional (hologram or hologram-like) images, which can be provided around the rim portion, within the side wall enclosed portion, or both. In addition to repeated images, a series of different, related images might be used, for example, the numerals 0–9, the alphabet, a color spectrum, related characters or a story summarized in images from literature, television, movies, etc.

While single-piece and two-piece drinking tubes have been disclosed, three or more pieces can be used in the fabrication of such tubes. For example, a significantly heavier second end member can be provided and mated to the remaining free end of a thinner, lighter coiled portion of the tube. Preferably, the containers, lids, drinking tubes and seals of the present invention would be formed of materials conventionally employed in making such component for use as drinking or beverage containers or implements. The drinking tubes of the present invention are preferably constructed from suitably selected polymer plastic material(s) which are easily formed, sanitary and safe for cleaning, particularly in dishwashers and, preferably, which retain a desired loop shape(s) while providing the desired flexibility permitting at least the looped portion of the drinking tube to collapse upon itself preferably into a tight helical coil or a planar spiral or to extend axially away from a first end of the tube, which is exposed through or at least held proximal to the mouth of the container or the lid. That, together with proper weighting of the remainder of the drinking tube within the container, will assure that the second end opening will locate in the liquid remaining in the container, regardless of the orientation of the container. This is especially important when drinking is being done with other activities, for example driving, running, bike riding, etc., when it is important that the user continue to be able to see his or her surroundings without restricting their vision when the device is inverted. It is also beneficial to such athletes, e.g. joggers, bikers, etc., to continue any competition they may be involved in without interruption.

The present designs eliminate unnatural bending and/or the significant danger of creasing and closure of either rigid or extremely flexible, tubular members, which have been previously used or suggested for such devices. The drinking tubes of the present invention can be stored within the container when not in use and can be made totally sanitary and reusable or disposable. In the case of a nursing bottle, the present invention eliminates the provision of air to the nursing infant and thus the likelihood of colic. There are no small or moving parts to endanger a child. Drinking devices of the present invention can also be of special benefit to people with certain handicaps and/or infirmities because such devices can be used in any orientation.

While several preferred embodiments of the present invention have been disclosed and modifications thereto suggested, it will be recognized by those skilled in the art that still other changes could be made to the above-identified embodiments of the invention without departing from the broad inventive concepts thereof. It should be understood, therefore, that the invention is not limited to the particular embodiments disclosed, but is intended to cover all modifications which are within the scope and spirit of the invention, as defined by the appended claims.

I claim:

1. A drinking device comprising:

a container having a base, an upper end opposing the base, an interior and a mouth providing access to the container interior; and a drinking tube having opposing first and second open ends, the first end being held at least proximal the container mouth and at least part of a remaining portion of the drinking tube extending away from the first end in loops extending more than once completely around within the container interior, the second end of the drinking tube being located proximal the base when the device is supported in an upright position on the base and proximal to the upper end of the container when the device is supported in an inverted position with the upper end down and the loops of the remaining portion of the drinking tube being sufficiently flexible to freely collapse and extend axially at least under the weight of the remaining portion of the drinking tube, the remaining portion of the drinking tube being sufficiently resilient to resist collapse of its side wall and to remain in a looped state both when the remaining portion has collapsed axially upon itself and when the remaining portion has extended axially away from the first end.

2. The device of claim 1 wherein at least the loops of the remaining portion of the drinking tube assume the shape of a planar spiral within the container interior in some orientation of the drinking device.

3. The device of claim 2 wherein the mouth is located in the upper end of the container and the planar spiral is formed by the part of the remaining portion of the drinking tube resting against the upper end of the container when the device is inverted.

4. The device of claim 1 wherein the drinking tube is configured so that the second end lies proximal a center line of the container in at least some orientation of the device.

5. The device of claim 1 wherein the second end of the drinking tube is weighted.

6. The device of claim 1 further comprising a lid, at least generally sealing the mouth of the container, the first end of the drinking tube defining an opening through the lid into the container interior.

7. The device of claim 6 wherein the first end of the drinking tube extends through and protrudes outwardly from the lid and further comprising a cap sealingly received on the protruding first end.

8. The device of claim 1 in combination with a soft, flexible nursing nipple positioned over the container mouth, a support member holding the first end of the drinking tube at the container mouth fluidly coupled with the nipple, and an annular cap threaded onto the mouth of the container, securing the nipple with the container.

9. The device of claim 1 wherein the first end of the drinking tube is releasably secured to a sealing closure, the sealing closure being releasably secured to the device, sealing the device.

10. The device of claim 1 wherein the loops of the remaining portion of the tube are sufficiently flexible to collapse and extend axially under their own weight.

11. The drinking device of claim 1 further comprising a reflective coating on the base of the container applied to be visible from a mouth end of the container.

12. The drinking device of claim 1 further comprising an adhesive-backed transfer foil attached to the base of the container so as to be visible from a mouth end of the container.

13. The device of claim 1 wherein the mouth is located in the upper end of the container and wherein the remaining portion of the drinking tube is located in the upper end of the container when the device is inverted.

14. A drinking device comprising:

a container lid having a central portion with opposing first and second major sides and a skirt extending in an axial direction away from one side of the central portion around a periphery of the central portion; and a drinking tube secured with the lid and having opposing first and second open ends, the first end extending at least to an opening through the lid and at least part of a remaining portion of the drinking tube extending away from the lid and the first end in a loop of more than one revolution, at least the loop part of the drinking tube being sufficiently flexible such that each loop formed by the part freely collapses and extends in the axial direction, at least under the weight of the loop part of the drinking tube, and at least the loop part of the remaining portion of the drinking tube being sufficiently resilient to resist collapse of its side wall and to remain in a looped state both when the remaining portion has collapsed axially upon itself and when the remaining portion has extended axially away from the first end.

15. The drinking device of claim 14 wherein the container lid includes a central, axially extending passage receiving and retaining the first end of the drinking tube and further comprising a central post member with a tapered outer surface and a closure member with an inner tapered surface configured to mate with center post member surface and seal the passageway, at least one of the central post member and the closure member being slidably movable in the passageway, and sealing the passageway with the remaining member in at least one position of the slidably movable member.

* * * * *